US007926297B2

(12) United States Patent
Matsui et al.

(10) Patent No.: US 7,926,297 B2
(45) Date of Patent: Apr. 19, 2011

(54) AIR CONDITIONING SYSTEM

(75) Inventors: Nobuki Matsui, Osaka (JP); Tetsuyuki Kondo, Shiga (JP)

(73) Assignee: Daikin Industries, Ltd., Osaka (JP)

( * ) Notice: Subject to any disclaimer, the term of this patent is extended or adjusted under 35 U.S.C. 154(b) by 562 days.

(21) Appl. No.: 11/920,239

(22) PCT Filed: May 24, 2006

(86) PCT No.: PCT/JP2006/310319

§ 371 (c)(1),
(2), (4) Date: Nov. 13, 2007

(87) PCT Pub. No.: WO2006/126572

PCT Pub. Date: Nov. 30, 2006

(65) Prior Publication Data

US 2009/0025408 A1 Jan. 29, 2009

(30) Foreign Application Priority Data

May 24, 2005 (JP) ..... 2005-151491

(51) Int. Cl.
*F25B 49/00* (2006.01)

(52) U.S. Cl. ..... 62/176.6; 62/232

(58) Field of Classification Search ..... 62/176.6, 62/94, 232; 236/44 A, 44 C
See application file for complete search history.

(56) References Cited

U.S. PATENT DOCUMENTS

| | | | | |
|---|---|---|---|---|
| 4,786,301 | A * | 11/1988 | Rhodes | 62/271 |
| 4,911,357 | A * | 3/1990 | Kitamura | 236/44 E |
| 5,778,147 | A * | 7/1998 | Kim | 392/473 |
| 5,950,442 | A * | 9/1999 | Maeda et al. | 62/175 |
| 6,161,763 | A * | 12/2000 | Reuter | 236/44 C |
| 6,230,980 | B1 * | 5/2001 | Hudson | 236/44 A |
| 6,826,921 | B1 * | 12/2004 | Uselton | 62/176.6 |
| 6,959,875 | B2 * | 11/2005 | Yabu et al. | 236/44 C |
| 7,386,988 | B1 * | 6/2008 | Petschauer | 62/176.6 |
| 7,472,553 | B2 * | 1/2009 | Ikegami et al. | 62/94 |
| 7,647,785 | B2 * | 1/2010 | Fujiyoshi et al. | 62/176.6 |
| 2006/0059928 | A1 * | 3/2006 | Fujiyoshi et al. | 62/176.6 |
| 2006/0196195 | A1 * | 9/2006 | Ikegami et al. | 62/94 |
| 2006/0260332 | A1 * | 11/2006 | Matsui et al. | 62/94 |
| 2009/0025408 | A1 * | 1/2009 | Matsui et al. | 62/176.6 |

FOREIGN PATENT DOCUMENTS

| | | | |
|---|---|---|---|
| JP | 63-93617 | A | 4/1988 |
| JP | 6-300346 | A | 10/1994 |
| JP | 7-280324 | A | 10/1995 |
| JP | 8-496 | B2 | 1/1996 |
| JP | 2003-106609 | A | 4/2003 |
| JP | 2004-294048 | A | 10/2004 |

* cited by examiner

*Primary Examiner* — George Nguyen
(74) *Attorney, Agent, or Firm* — Birch, Stewart, Kolasch & Birch, LLP

(57) ABSTRACT

In an input section (30), a set temperature Ts which becomes a control target temperature of a humidity controller (10), and a set relative humidity Rs which becomes a control target humidity of the humidity controller (10) are set. An air conditioning control section (42) adjusts the temperature adjusting capacity of the humidity controller (10) such that the room temperature may come very close to the set temperature Ts. Further, an arithmetic section (33) calculates, as the target absolute humidity As, the absolute humidity which becomes the relative humidity set value Rs at the set temperature Ts. A humidity adjustment section (41) adjusts the humidity adjusting capacity of the humidity controller (10) such that the absolute humidity of the room may come very close to the target absolute humidity As.

5 Claims, 6 Drawing Sheets

First operation

Second operation

AIR CONDITIONING SYSTEM

TECHNICAL FIELD

The present invention relates to an air conditioning system for conditioning air of the same room with a humidity controller for processing a latent heat load of the room and an air conditioner for processing a sensible heat load of the room.

Various air conditioning apparatuses such as air conditioners for processing a sensible heat load of a room and humidity controllers for processing a latent heat load of a room have hitherto been known.

For example, there is disclosed in Patent Document 1 an air conditioner in which a refrigerant circulates in a refrigerating circuit to perform a cycle of steam compression and refrigeration. To the refrigerating circuit of the air conditioner, a compressor, a room heat exchanger, an expansion valve, an outdoor heat exchanger, and a four-way selector valve are connected. In this air conditioner, the circulating direction of the refrigerant is reversible through switching of the four-way selector valve, and switching between refrigerating operation and heating operation is made possible. In the refrigerating operation, air refrigerated in the room heat exchanger, which serves as an evaporator, is supplied to the room, thus refrigerating the room. In the heating operation, air heated in the room heat exchanger, which serves as a condenser, is supplied to the room, thus heating the room.

Still further, for example, in Patent Document 2, there is known a humidity controller in which an adsorption heat exchanger supporting an adsorbing agent which performs adsorption of moisture is connected to a refrigerant circuit. This humidity controller is arranged such that the above-mentioned adsorption heat exchanger functions as an evaporator or a condenser as the circulating direction of the refrigerant switches, thereby enabling the operation to switch between the dehumidifying operation and the humidifying operation. For example, in the dehumidifying operation, the adsorbing agent is refrigerated by the refrigerant evaporating in the adsorption heat exchanger with moisture of the air being adsorbed by this adsorbing agent. The air dehumidified by providing moisture to the adsorbing agent is supplied to the room, thereby dehumidifying the room. On the other hand, in the humidifying operation, the adsorbing agent is heated by the refrigerant condensed in the adsorption heat exchanger and the moisture adsorbed in the adsorbing agent is released. The air humidified by containing this moisture is supplied to the room, thereby humidifying the room.

[Patent Document 1] Japanese Unexamined Patent Application Publication No. 2003-106609

[Patent Document 2] Japanese Unexamined Patent Application Publication No. 2004-294048

DISCLOSURE OF THE INVENTION

Problems that the Invention is to Solve

Incidentally, the relative humidity of a room greatly contributes to a range of comfort regarding room humidity. It is, therefore, necessary to operate the above-described humidity controller such that the relative humidity of the room is in the range of comfort. Further, to improve comfortability in a room, both room humidity and relative humidity of the room need to be maintained on comfortable levels. In view of this, the use in the same room of the air conditioner for processing a sensible heat load in the room and a humidity controller for processing a latent heat load in the room, as described above, is contemplated.

On the other hand, when room air conditioning is carried out by using both the air conditioner and the humidity controller, since the room temperature changes with the operation of the air conditioner, the relative humidity of the room also changes. As a result, for example, if the capacity of the humidity controller is controlled on the basis of the relative humidity of the room at that point in time, it becomes difficult to maintain immediately both the room temperature and the relative humidity within comfortable ranges.

In view of the foregoing, it is the object of the present invention to propose, in air conditioning systems provided with a humidity controller and an air conditioner, an air conditioning system that can immediately and comfortably maintain both temperature and relative humidity of a room.

Means of Solving the Problems

A first aspect of the invention is based on an air conditioning system including a humidity controller (10) for processing a latent heat load of a room, and an air conditioner (20) for processing a sensible heat load of a room, the air conditioning system supplying to the same room air processed in the humidity controller (10) and the air conditioner (20) on the basis of a target temperature Ts and a target relative humidity Rs. The air conditioning system includes: an air conditioning control section (42) for adjusting a processing capacity of the air conditioner (20) such that room temperature may come very close to the target temperature Ts; an arithmetic section (33) for calculating an absolute humidity as a target absolute humidity As, the absolute humidity becoming the target relative humidity Rs at the target temperature Ts; and a humidity adjustment section (41) for adjusting a processing capacity of the humidity controller (10) such that the absolute humidity of the room may come very close to the target absolute humidity As.

In the air conditioning system of the first aspect of the invention, by operating the humidity controller (10) and the air conditioner (20), humidity adjustment and temperature control of a room are simultaneously performed. The above-mentioned air conditioner (20) is such that its temperature control capacity is controlled by the air conditioning control section (42) so that the room temperature may come very close to the target temperature Ts. As a result, the room temperature gradually converges to the target temperature Ts to be finally maintained at the target temperature Ts. On the other hand, the humidity controller (10) is such that its humidity adjusting capacity may be controlled so that the room relative humidity may come very close to the target relative humidity Rs. Specifically, first, the arithmetic section (33) calculates a target absolute humidity As that becomes the target relative humidity Rs under the condition of the target temperature Ts from the target temperature Ts, which becomes the room control target temperature, and the target relative humidity Rs, which becomes the room target control humidity. Then, the humidity adjustment section (41) calculates a necessary humidity adjusting capacity of the humidity controller (10), for example, from an actual absolute humidity of the room and the above-mentioned absolute humidity As, followed by adjusting the humidity adjusting capacity of the humidity controller (10) to this necessary processing capacity. In other words, the humidity adjusting capacity of the humidity controller (10) is so adjusted as to fulfill the target relative humidity Rs, which becomes the control target humidity at the target temperature Ts.

According to a second aspect of the invention, in the first aspect of the invention, the air conditioning system further includes an input section (30) through which a user inputs the target relative humidity Rs as a set relative humidity.

In the second aspect of the invention, the target relative humidity Rs, which the user desires, is inputted through the input section (30) as the set relative humidity. That is, the humidity adjusting capacity of the humidity controller (10) is so adjusted as to fulfill the relative humidity set value Rs at the target temperature Ts.

According to a third aspect of the invention, in the first aspect of the invention, the air conditioning system further includes: an input section (30) through which a user inputs the target temperature Ts as a set temperature; and a decision-making section for automatically determining the target relative humidity Rs according to the set temperature.

In the third aspect of the invention, the target temperature Ts, which the user desires, is inputted through the input section (30) as the set temperature. Further, the decision-making section automatically determines the target relative humidity Rs corresponding to this set temperature on the basis of the set temperature inputted to the input section (30). That is, the humidity adjusting capacity of the humidity controller (10) is so adjusted as to fulfill the above-mentioned target relative humidity Rs at the target temperature Ts.

According to a fourth aspect of the invention, in the first aspect of the invention, the humidity controller (10) has a refrigerant circuit (50) to which adsorption heat exchangers (51 and 52) supporting an adsorbing agent that adsorbs moisture in air is connected, the refrigerant circuit performing a freezing cycle. The air conditioning system adjusts the humidity of air that is in contact with the adsorbing agent of the adsorption heat exchangers (51 and 52) by heating or refrigerating the adsorbing agent with a refrigerant of the refrigerant circuit (50), and processes the latent heat load of the room by supplying the humidity-adjusted air to the room.

The humidity controller (10) according to the fourth aspect of the invention is provided with the refrigerant circuit (50) for performing a freezing cycle in which the refrigerant circulates. To this refrigerant circuit (50), there are connected the adsorption heat exchangers (51 and 52) supporting the adsorbing agent on the surfaces thereof. These adsorption heat exchangers (51 and 52) function as an evaporator or a condenser depending on the direction of flow of the refrigerant in the refrigerant circuit.

Specifically, for example, when the adsorption heat exchangers (51 and 52) function as an evaporator, the adsorbing agent is refrigerated by the refrigerant. When air passes through the adsorption heat exchangers (51 and 52), moisture in the air is adsorbed by the adsorbing agent. When air dehumidified in the above manner is supplied to the room, room undergoes dehumidification. On the other hand, for example, when the adsorption heat exchangers (51 and 52) function as a condenser, the adsorbing agent is heated by the refrigerant. When air passes through the adsorption heat exchangers (51 and 52), moisture released from the adsorbing agent is imparted to the air. When air humidified in the above manner is supplied to the room, the room undergoes humidification.

Effects of the Invention

According to the present invention, the humidity adjusting capacity of the humidity controller (10) is adjusted in such a manner as to fulfill the target relative humidity Rs at the target temperature Ts of the air conditioner (20). At this point, since the air conditioner (20) has the target temperature Ts as its control target temperature, it may be predicted that after a while from the startup of the air conditioner (20), the room temperature reaches the target temperature Ts. On the other hand, since the humidity controller (10) is so controlled from the startup of the air conditioner (20) as to fulfill the target relative humidity Rs at the target temperature Ts, the relative humidity of the room can be caused to converge immediately to the target relative humidity Rs. Thus, in this air conditioning system, the room temperature and the relative humidity can be immediately maintained on comfortable levels.

Further, according to the present invention, the target temperature Ts used for temperature conditioning of the air conditioner (20) is also used on the humidity controller (10) side. This eliminates the need for additionally providing an input section and the like, making it possible to maintain the room temperature and the relative humidity on comfortable levels using a relatively simple configuration.

Further, according to the second aspect of the invention, the target relative humidity Rs, which the user desires, can be inputted through the input section (30) as the set relative humidity. That is, the humidity adjusting capacity of the humidity controller (10) of the air conditioning system can be changed by the user as necessary according to the set relative humidity inputted by the user.

Further, according to the third aspect of the invention, the target temperature Ts, which the user desires, can be inputted through the input section (30) as the set temperature. That is, the temperature controlling capacity of the air conditioner (20) of the air conditioning system can be changed by the user as necessary according to the set temperature inputted by the user. Furthermore, in the decision-making section, if the room temperature is the set temperature, the relative humidity which the user feels comfortable under such temperature condition is automatically determined as the target relative humidity Rs. That is, without user's inputting the set relative humidity, the relative humidity of the room which the user feels comfortable is automatically determined as the target relative humidity Rs, making it possible to maintain the room humidity on comfortable levels.

Further, according to the fourth aspect of the invention, the humidity adjusting capacity of the humidity controller can be easily adjusted on multi-levels, for example, by adjusting as necessary the heating amount and the cooling amount of the adsorbing agent through the refrigerant of the refrigerant circuit (50) or contact time between the adsorbing agent and the air.

REFERENCE NUMERAL

Figure 1:
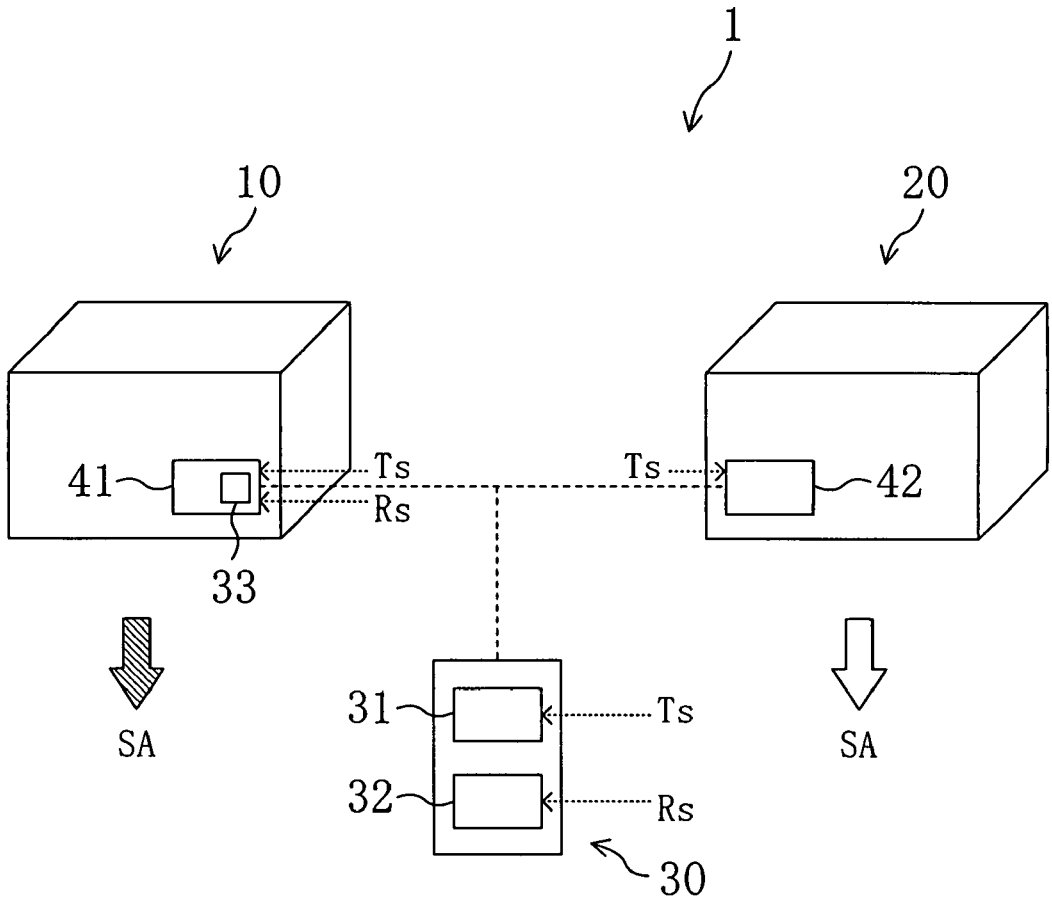
FIG. 1 is a schematic block diagram of an air conditioning system which represents an embodiment.

1 Air conditioning system
10 Humidity controller

20 Air conditioner
30 Controller (input portion)
41 Humidity adjustment section
42 Air conditioning section
50 Refrigerating circuit
51 First adsorption heat exchanger (adsorption heat exchanger)
52 Second adsorption heat exchanger (adsorption heat exchanger)

BEST MODE FOR CARRYING OUT THE INVENTION

Embodiments of the present invention will be described. As shown in FIG. 1, an air conditioning system (1) of this embodiment has a humidity controller (10) for processing latent heat of air and an air conditioner (20) for processing sensible heat of air. In the air conditioning system (1), air processed in the humidity controller (10) and air processed in the air conditioner (20) are both supplied to the same room. The air conditioning system (1) also has a humidity control section (41), an air conditioning control section (42), and a controller (30), which will be detailed later.

<Schematic Configuration of the Humidity Controller>

The humidity controller (10) of this embodiment is so configured as to enable dehumidifying operation to supply dehumidified air to the room and humidifying operation to supply humidified air to the room.

As shown in FIG. 2, the above-mentioned humidity controller (10) is provided with a refrigerant circuit (50). This refrigerant circuit (50) is a closed circuit provided with a first adsorption heat exchanger (51), a second adsorption heat exchanger (52), a compressor (53), a four-way selector valve (54), and a motorized expansion valve (55). By circulating a filled refrigerant, the refrigerant circuit (50) performs a steam compression freezing cycle.

In the above refrigerant circuit (50), an ejection side of the compressor (53) is linked to a first port of the four-way selector valve (54), while a suction side of the compressor (53) is linked to a second port of the four-way selector valve (54). One end of the first adsorption heat exchanger (51) is linked to a third port of the four-way selector valve (54). The other end of the first adsorption heat exchanger (51) is linked via the motorized expansion valve (55) to one end of the second adsorption heat exchanger (52). The other end of the second adsorption heat exchanger (52) is linked to a fourth port of the four-way selector valve (54).

Figure 2B:
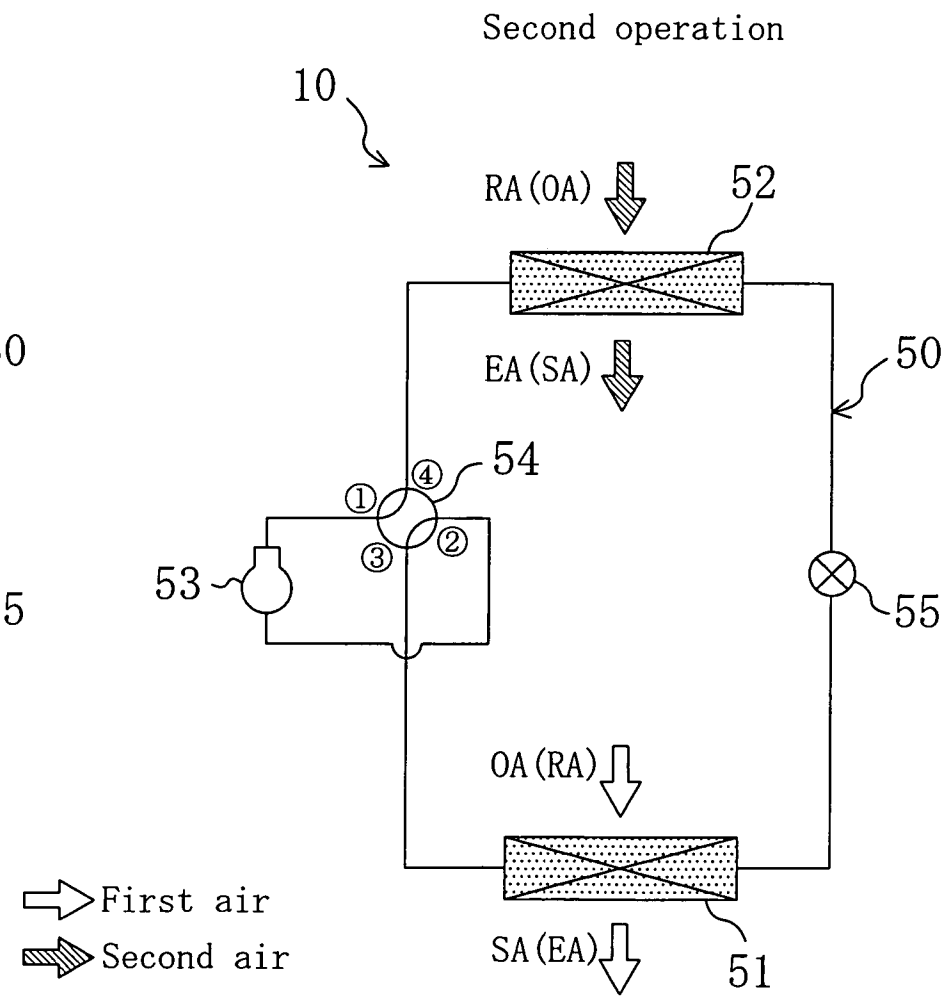
FIG. 2 is a piping system diagram showing a construction of a refrigerant circuit of a humidity controller of an embodiment; (A) shows operation during the first operation, and (B) shows operation during the second operation.
Figure 2A:
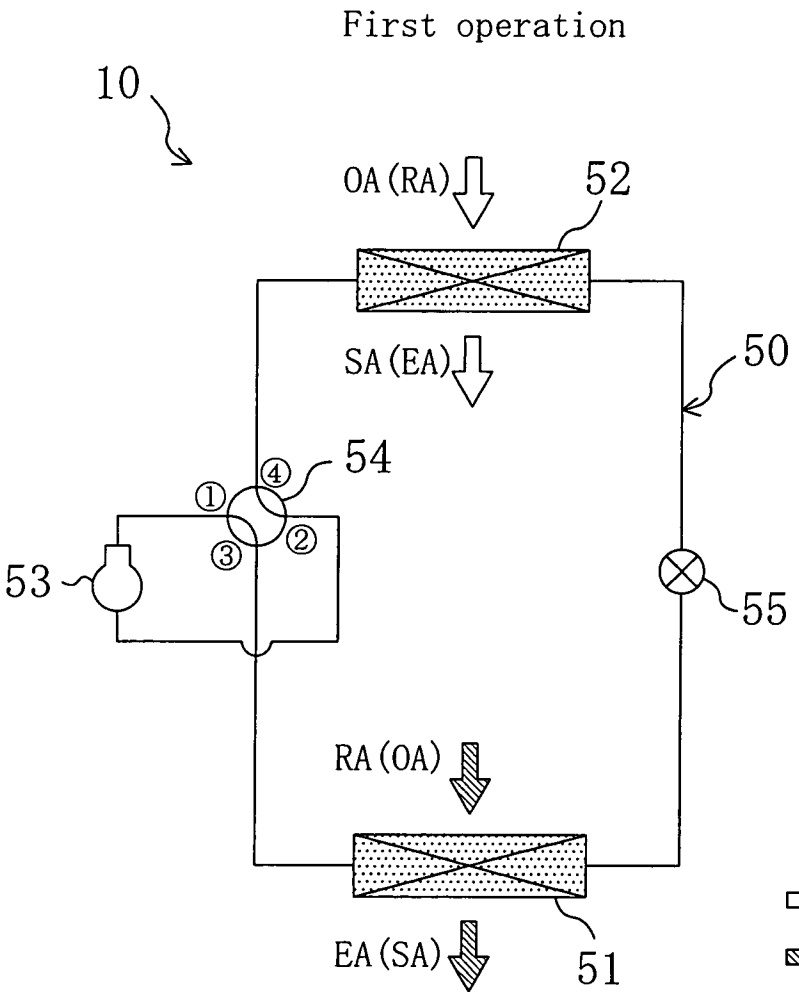

The above-mentioned four-way selector valve (54) is such that a first condition (condition shown in FIG. 2(A)) in which the first port and the third port are in communication while the second port and the fourth port are in communication can be switched to a second condition (condition shown in FIG. 2(B)) in which the first port and the fourth port are in communication while the second port and the third port are in communication.

Figure 3:
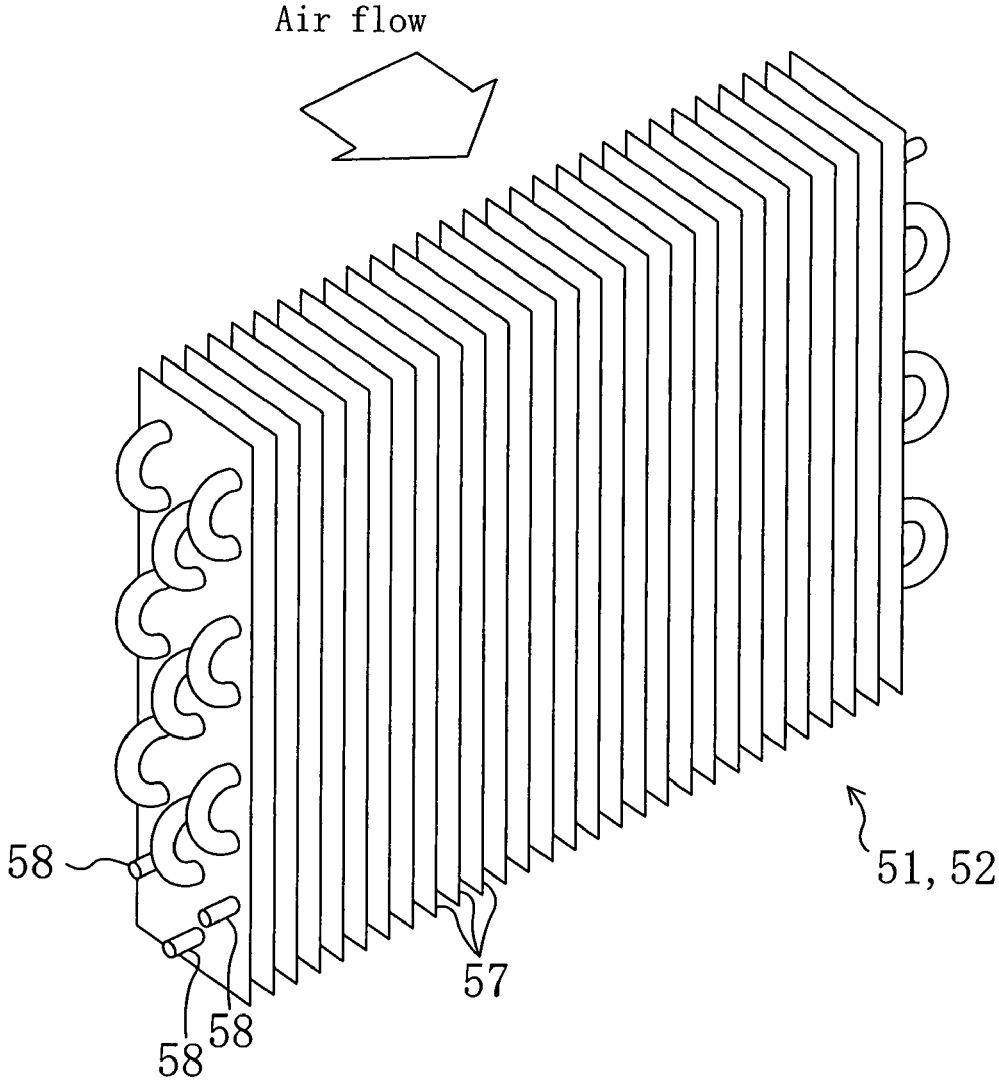
FIG. 3 is a schematic perspective view of an adsorption heat exchanger.

As shown in FIG. 3, the first adsorption heat exchanger (51) and the second adsorption heat exchanger (52) are both constituted of a fin and tube heat exchanger of the cross fin type. These adsorption heat exchangers (51 and 52) are provided with copper heat transfer pipes (58) and aluminum-made fins (57). A plurality of fins (57) set up on the adsorption heat exchangers (51 and 52) are respectively formed in an oblong plate shape and arranged at a preset spacing. Further, the heat transfer pipes (58) are provided to pierce through the fins (57).

In each of the above-mentioned adsorption heat exchangers (51 and 52), the adsorbing agent is supported on the surface of each fin (57), so that air passing through the fins (57) comes into contact with the adsorbing agent on the surface of the fins (57). As the adsorbing agent, there are employed those materials which can adsorb moisture vapor in air such as zeolite, silica gel, activated charcoal, and any other organic high-molecule material having a hydrophilic functional group.

Further, the humidity controller (10) is provided with a plurality of sensors, not shown, for measuring air temperature and humidity. These plurality of sensors are constituted of an outdoor temperature sensor detecting the temperature of outdoor air, an outdoor humidity sensor detecting the relative humidity of outdoor air, a room temperature sensor detecting the temperature of room air, and a room humidity sensor detecting the relative humidity of the room air.

<Schematic Configuration of the Air Conditioner>

The air conditioner (20) of this embodiment is so configured as to enable refrigerating operation to supply refrigerated air to the room and heating operation to supply heated air to the room.

As shown in FIG. 4, the above-mentioned air conditioner (20) has a room unit (21) and an outdoor unit (22). The room unit (21) is arranged in the room, and a room heat exchanger (62) is housed in this room unit (21). On the other hand, the above-mentioned outdoor unit (22) is arranged outdoors. This outdoor unit (22) houses an outdoor heat exchanger (61), a compressor (63), a four-way selector valve (64), and a motorized expansion valve (65). The above-mentioned room unit (21) and the above-mentioned outdoor unit (22) are mutually linked by two connecting pipes (23 and 24). This air conditioner (20) is constituted of a refrigerant circuit (60) which is a closed circuit. This refrigerant circuit (60) performs a steam-pressure compression freezing cycle by circulating filled refrigerant.

In the above-mentioned refrigerant circuit (60), an ejection side of the compressor (63) is linked to a first port of the four-way selector valve (64) while a suction side the compressor (63) is linked to a second port of the four-way selector valve (64). One end of the outdoor heat exchanger (61) is linked to a third port of the four-way selector valve (64), while the other end of the outdoor heat exchanger (61) is linked via the motorized expansion valve (65) to one end of the room heat exchanger (62). The other end of the room heat exchanger (62) is linked to a fourth port of the four-way selector valve (64).

Figure 4B:
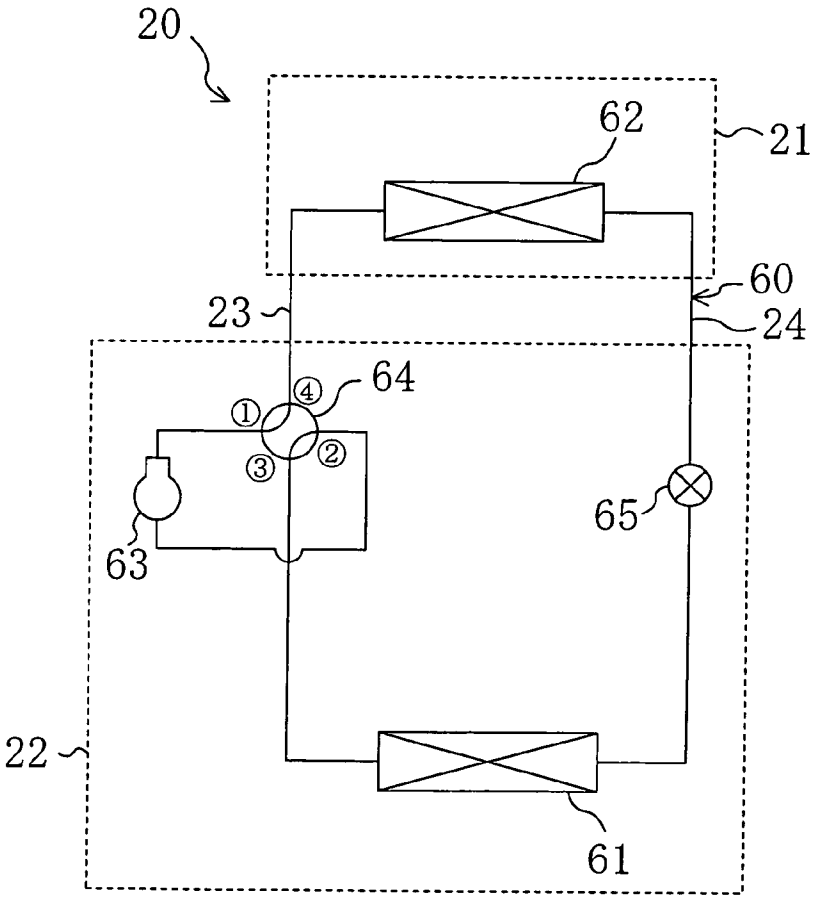
FIG. 4 is a piping system diagram showing construction of a refrigerant circuit of an air conditioner of an embodiment, (A) shows the first condition, and (B) shows the second condition.
Figure 4A:
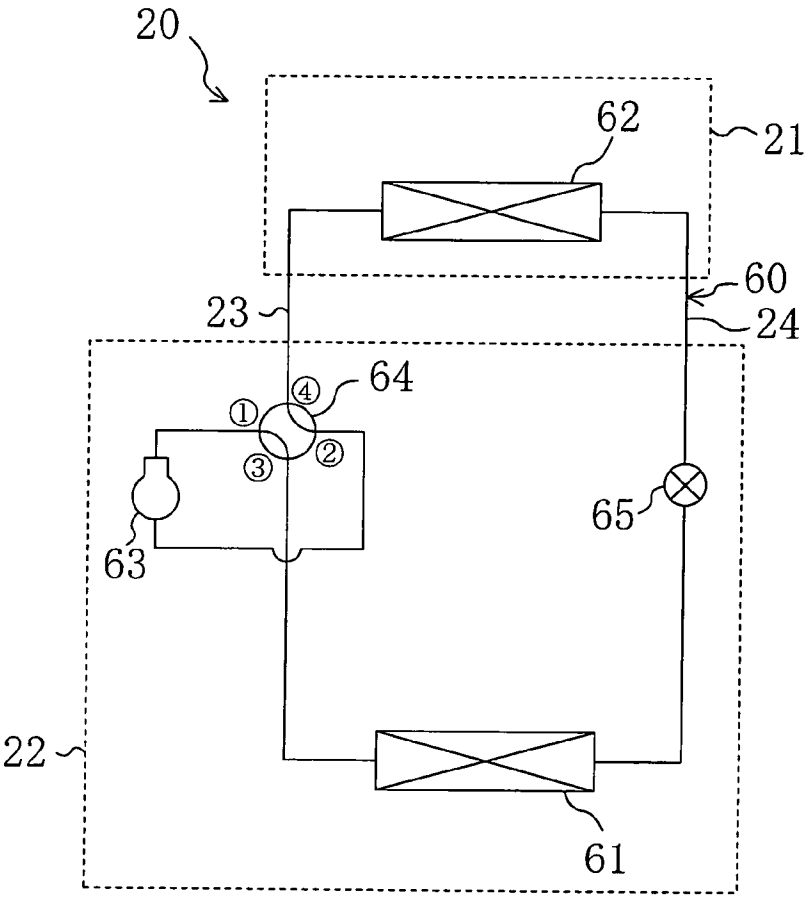

The above-mentioned four-way selector valve (64) is such that a first condition (condition shown in FIG. 4(A)) in which the first port and the third port are in communication while the second port and the fourth port are in communication can be switched to a second condition (condition shown in FIG. 4(B)) in which the first port and the fourth port are in communication while the second port and the third port are in communication. Further, the air conditioner (20) is provided with a suction temperature sensor for detecting the temperature of air to be sucked into the air conditioner (20).

<Configuration of the Humidity Adjustment Section, the Air Conditioning Control Section, and the Controller>

As shown in FIG. 1, the controller (30), the humidity adjustment section (41), and the air conditioning control section (42) are provided in the air conditioning system (1) of this embodiment.

The above-mentioned controller (30) is constituted of an input section to input the temperature set value Ts which becomes a control target of the air conditioner (20) and the relative humidity set value Rs which becomes a control target of the humidity controller (10). Specifically, a temperature setting section (31) and a humidity setting section (32) are provided in the controller (30).

A desired room temperature is inputted into the above-mentioned temperature setting section (31). The target temperature of the room is set as the set temperature Ts in the temperature setting section (31). On the other hand, a desired room humidity condition is inputted into the above-mentioned humidity setting section (32). Specifically, the desired humidity condition is selectively inputted into the humidity setting section (32) out of three levels: "Low", "Medium", and "High". The room target humidity corresponding to the inputted humidity condition is set in the humidity setting section (32) as the relative humidity set value Rs.

The above-mentioned air conditioning control section (42) receives the temperature set value Ts set in the controller (30). This air conditioning control section (42) adjusts the temperature adjusting capacity of the air conditioner (20) to cause the room temperature to come very close to the above-mentioned temperature set value Ts.

The humidity adjustment section (41) receives the set temperature Ts and the set relative humidity Rs which were set in the controller (30). This humidity adjustment section (41) is provided with an arithmetic section (33). From the set temperature Ts and the set relative humidity Rs received by the humidity adjustment section (41), this arithmetic section (33) calculates the absolute humidity which becomes the set relative humidity Rs at the set temperature Ts, and sets the absolute humidity to the target absolute humidity As. Further, the humidity adjustment section (41) adjusts the humidity adjusting capacity of the humidity adjustment section (41) to cause the absolute humidity of the room to come very close to the above-mentioned target absolute humidity As (detailed later).

—Operation—

<Operation of the Humidity Controller>

In the humidity controller (10) of this embodiment, the dehumidifying operation and the humidifying operation are performed. When in the dehumidifying operation and the humidifying operation, the humidity controller (10) subjects taken-in outdoor air (OA) to humidity adjustment, then supplies such air as supply air (SA) to the room, while, at the same time, ejecting the taken-in room air (RA) as ejected air (EA). Namely, the humidity controller (10) in the dehumidifying operation and the humidifying operation performs air ventilation. Further, the humidity controller (10) alternately repeats the first operation and the second operation at preset time intervals (e.g., 3-minute intervals) during either the dehumidifying operation or the humidifying operation.

The humidity controller (10) takes in, during the dehumidifying operation, outdoor air (OA) as the first air and room air (RA) as the second air. Further, the humidity controller (10) takes in, during the humidifying operation, room air (RA) as the first air and outdoor air (OA) as the second air.

First, the first operation will be described. During the first operation, the second air is sent to the first adsorption heat exchanger (51) and the first air is sent to the second adsorption heat exchanger (52). In this first operation, regenerating action is performed regarding the first adsorption heat exchanger (51) and adsorption action is performed regarding the second adsorption heat exchanger (52).

As shown in FIG. 2(A), in the refrigerant circuit (50) during the first operation, the four-way selector valve (54) is set in the first condition. When the compressor (53) is operated, the refrigerant circulates in the refrigerant circuit (50). Specifically, the refrigerant ejected from the compressor (53) releases heat in the first adsorption heat exchanger (51) to be condensed. The refrigerant condensed in the first adsorption heat exchanger (51) is depressurized when passing through the motorized expansion valve (55), thereafter absorbing heat in the second adsorption heat exchanger (52) to be evaporated. The refrigerant evaporated in the second adsorption heat exchanger (52) is sucked into the compressor (53) and compressed, and again ejected from the compressor (53).

In this manner, in the refrigerant circuit (50) during the first operation, the first adsorption heat exchanger (51) operates as the condenser, while the second adsorption heat exchanger (52) operates as the evaporator. In the first adsorption heat exchanger (51), the adsorbing agent on the surfaces of the fins (57) is heated by the refrigerant in the heat transfer pipe (58), so that moisture desorbed from the heated adsorbing agent is provided to the second air. On the other hand, in the second adsorption heat exchanger (52), moisture in the first air is adsorbed by the adsorbing agent on the surfaces of the fins (57), and the generated adsorption heat is absorbed by the refrigerant in the heat transfer pipe (58).

Then, if during the dehumidifying operation, the first air dehumidified in the second adsorption heat exchanger (52) is supplied to the room, while the moisture desorbed from the first adsorption heat exchanger (51) is ejected outdoors together with the second air. On the other hand, if during the humidifying operation, the second air humidified in the first adsorption heat exchanger (51) is supplied to the room, while the first air deprived of moisture in the second adsorption heat exchanger (52) is ejected outdoors.

Next, the second operation will be described. During the second operation, the first air is sent to the first adsorption heat exchanger (51) and the second air is sent to the second adsorption heat exchanger (52). In this second operation, regenerating action is performed regarding the second adsorption heat exchanger (52) and adsorption action is performed regarding the first adsorption heat exchanger (51).

As shown in FIG. 2(B), in the refrigerant circuit (50) during the second operation, the four-way selector valve (54) is set in the second condition. When the compressor (53) is operated, the refrigerant circulates in the refrigerant circuit (50). Specifically, the refrigerant ejected from the compressor (53) releases heat in the second adsorption heat exchanger (52) to be condensed. The refrigerant condensed in the second adsorption heat exchanger (52) is depressurized when passing through the motorized expansion valve (55), thereafter absorbing heat in the first adsorption heat exchanger (51) to be evaporated. The refrigerant evaporated in the first adsorption heat exchanger (51) is sucked into the compressor (53) and compressed, and again ejected from the compressor (53).

In this manner, in the refrigerant circuit (50), the second adsorption heat exchanger (52) operates as the condenser, while the first adsorption heat exchanger (51) operates as the evaporator. In the second adsorption heat exchanger (52), the adsorbing agent on the surfaces of the fins (57) is heated by the refrigerant in the heat transfer pipe (58), while moisture released from the heated adsorbing agent is provided to the second air. On the other hand, in the first adsorption heat exchanger (51), moisture in the first air is adsorbed by the adsorbing agent on the surfaces of the fins (57), and the generated adsorption heat is absorbed by the refrigerant in the heat transfer pipe (58).

Then, if during the dehumidifying operation, the first air dehumidified in the first adsorption heat exchanger (51) is supplied to the room, while the moisture released from the second adsorption heat exchanger (52) is ejected outdoors together with the second air. On the other hand, if during the humidifying operation, the second air humidified in the second adsorption heat exchanger (52) is supplied to the room, and the first air deprived of moisture in the first adsorption heat exchanger (51) is ejected outdoors.

<Operation of the Air Conditioner>

In the air conditioner (20) of this embodiment, refrigerating operation and heating operation are performed.

As shown in FIG. 4(A), in the refrigerating operation of the air conditioner (20), the four-way selector valve (64) of the refrigerant circuit (60) is set in the first condition. When the compressor (63) is operated, the refrigerant circulates in the refrigerant circuit (60). Specifically, the refrigerant ejected from the compressor (63) releases heat in the outdoor heat exchanger (61) to be condensed. The refrigerant condensed in the outdoor heat exchanger (61) is depressurized when passing through the motorized expansion valve (65), thereafter absorbing heat in the room heat exchanger (62) to be evaporated. The refrigerant evaporated in the room heat exchanger (62) is sucked into the compressor (63) and compressed, and again ejected from the compressor (63).

In this manner, in the refrigerant circuit (60), the outdoor heat exchanger (61) operates as the condenser, and the room heat exchanger (62) operates as the evaporator. On the other hand, air sucked from the room into the air conditioner (20) passes through the room heat exchanger (62) which operates as the evaporator. This air, after being refrigerated in the room heat exchanger (62), is supplied to the room.

On the other hand, in the heating operation of the air conditioner (20), as shown in FIG. 4(B), the four-way selector valve (64) of the refrigerant circuit (60) is set in the second condition. When the compressor (63) is operated, the refrigerant circulates in the refrigerant circuit (60). Specifically, the refrigerant ejected from the compressor (63) releases heat in the room heat exchanger (62) to be condensed. The refrigerant condensed in the room heat exchanger (62) is depressurized when passing through the motorized expansion valve (65), thereafter absorbing heat in the outdoor heat exchanger (61) to be evaporated. The refrigerant evaporated in the outdoor heat exchanger (61) is sucked into the compressor (63) and compressed, and again ejected from the compressor (63).

In this manner, in the refrigerant circuit (60), the outdoor heat exchanger (61) operates as the evaporator, and the room heat exchanger (62) operates as the condenser. On the other hand, air sucked from the room into the air conditioner (20) passes through the room heat exchanger (62), which operates as the condenser. This air, after being heated in the room heat exchanger (62), is supplied to the room.

<Control Operation of the Air Conditioning System>

In the air conditioning system (1) of this embodiment, by combining the dehumidifying operation or the humidifying operation of the humidity controller (10) mentioned above and the refrigerating operation or the heating operation of the air conditioner (20) mentioned above, four combinations of operations are performed. Specifically, in the air conditioning system (1), the following operations can be switched: the "refrigerating dehumidifying operation"—while performing the dehumidifying operation by the humidity controller (10), the refrigerating operation is simultaneously performed by the air conditioner (20); the "heating dehumidifying operation"—while performing the dehumidifying operation by the humidity controller (10), the heating operation is simultaneously performed by the air conditioner (20); the "refrigerating humidifying operation"—while performing the humidifying operation by the humidity controller (10), the refrigerating operation is simultaneously performed by the air conditioner (20); and the "heating humidifying operation"—while performing the humidifying operation by the humidity controller (10), the heating operation is simultaneously performed by the air conditioner (20).

Of these operations, the foregoing "refrigerating dehumidifying operation" is taken herein as a representative example to explain the controlling operation of the air conditioning system (1). As shown in FIG. 1, when the refrigerating dehumidifying operation is started in the air conditioning system (1), the dehumidifying operation by the humidity controller (10) mentioned above and the refrigerating operation by the air conditioner (20) mentioned above are simultaneously performed.

In the air conditioner (20), the set temperature Ts (e.g., 25° C.) set by the controller (30) is received by the air conditioning control section (42). In addition, a suction room temperature detected by a suction temperature sensor of the air conditioner (20) is received by the air conditioning control section (42). On the basis of a temperature difference between the detected temperature of the suction temperature sensor and the above-mentioned set temperature, the air conditioning control section (42) controls the refrigerating capacity of the air conditioner (20) so that the room temperature may come very close to the set temperature of 25° C. Specifically, control of the refrigerating capacity of this air conditioner (20) is carried out, for example, by adjusting the evaporating temperature of the refrigerant of the room heat exchanger (62) and the frequency of the compressor (63). As in the foregoing, in the air conditioner (20), the refrigerating operation is performed with the set temperature Ts as the target temperature. As a result, the room temperature gradually converges to the set temperature Ts, thus maintaining the set temperature of 25° C.

On the other hand, in the humidity controller (10), the set temperature Ts (25° C.) and the set relative humidity Rs (e.g., 40%) set by the controller (30) are received by the humidity adjustment section (41). In addition, the detected temperatures detected by the outdoor temperature sensor and the room temperature sensor of the humidity controller (10) and further, the detected humidity detected by the outdoor humidity sensor and the room humidity sensor of the humidity controller (10) are received by the humidity adjustment section (41). Next, the humidity adjustment section (41) calculates, as the target absolute humidity As, the absolute humidity which becomes the relative humidity of 40% at the set temperature of 25° C. from the temperature set value Ts and the relative humidity set value Rs. Further, the absolute humidity of the outdoor air (OA) is calculated by the arithmetic section (33) from the detected outdoor temperature and the detected outdoor humidity. Moreover, the absolute humidity of supplied air (SA) is calculated by the arithmetic section (33) from the detected temperature and the detected humidity of the room.

On the basis of the absolute humidity of the outdoor air (OA) and the supplied air (SA) as well as the target absolute humidity As mentioned above, the humidity adjustment section (41) controls the dehumidifying capacity of the humidity controller (10) so that the absolute humidity of the room may come very close to the target absolute humidity As. The humidifying capacity of the humidity controller (10) is controlled, for example, by adjusting the circulating amount of the refrigerant accompanying the frequency of the compressor (63) or by adjusting contact time between the adsorbing agent of absorption heat exchangers (51 and 52) and air as necessary.

In the foregoing manner, the dehumidifying operation is performed in the humidity controller (10) to fulfill the relative humidity Rs at the set humidity Ts. As a result, the room temperature comes close to the set temperature Ts due to the air conditioning operation of the above-mentioned air conditioner (20), while, at the same time, the relative humidity of the room gradually converges to the set relative humidity Rs. Finally, the room temperature is maintained at the temperature setting of 25° C., while the relative humidity of the room is maintained at the set relative humidity of 40%.

EFFECTS OF THE EMBODIMENT

According to the above-mentioned embodiment, the humidity adjusting capacity of the humidity controller (10) is adjusted to satisfy the target relative humidity Rs at the temperature set value Ts, which becomes the target control temperature of the air conditioner (20). At this point, since the air conditioner (20) has the set temperature Ts as the control target temperature, after a while from the startup of the air conditioner (20), the room temperature reaches the set temperature Ts. On the other hand, since the humidity controller (10) is so controlled since the startup time of the air conditioner (20) to satisfy the target relative humidity Rs at the set temperature Ts, the relative humidity of the room is immediately converged to the target relative humidity. Consequently, in this air conditioning system, the room temperature and the relative humidity can be quickly maintained at comfortable levels.

Further, according to the present invention, the set temperature Ts used for temperature control of the air conditioner (20) is also used on the humidity controller (10) side. This eliminates the need for an additional setting input section and the like, and the room temperature and the relative humidity can be maintained on comfortable levels under a relatively simple configuration.

Other Embodiments

While in the above-mentioned embodiment, the input sections of the temperature set value Ts and the relative humidity set value Rs are provided in the controller (30), the input sections may be provided, for example, in the humidity adjustment section (41) of the humidity controller (10) or in the air conditioning control section (42) of the air conditioner (20). That is, by making the humidity adjustment section (41) and the air conditioning control section (42) share the temperature set value Ts and the humidity set value Rs, the same temperature control/humidity adjusting operations as the above-mentioned embodiment can be carried out.

Further, the target humidity Rs may not necessarily be set by inputting the set humidity Rs manually by the user; the target humidity Rs may be automatically determined by the decision-making section according to the set temperature Ts inputted into the input section (30). That is, the room temperature and the optimum humidity (humidity that the user feels comfortable) corresponding to this room temperature are stored as data in advance in the decision-making section. The decision-making section, on the basis of the foregoing data, automatically determines, as the target relative humidity Rs, a humidity which is optimum at the set temperature Ts. Specifically, the decision-making section sets the target relative humidity Rs at 55% when the set temperature Ts is under 22° C.; when the temperature set value Ts is more than 22° C. and less than 26° C., the target relative humidity Rs is set at 50%; and when the temperature set value Ts is more than 26° C., the target relative humidity Rs is changed to 45%. That is, in this example, it is possible to determine the target relative humidity Rs corresponding to the room temperature condition even if the user does not input the target set humidity, thereby maintaining the room humidity on comfortable levels by the humidity controller (10).

Further, in the above-mentioned embodiment, the humidity controller (10) may be constituted as follows. At this point, modified examples of the humidity controller (10) will be described.

First Modified Example

As shown in FIG. 5, the humidity controller (10) of the first modified example is provided with a refrigerant circuit (100) and two adsorbing elements (111 and 112). The refrigerant circuit (100) is a closed circuit in which a compressor (101), a condenser (102), an expansion valve (103), and an evaporator (104) are connected by turns. When the refrigerant circuit (100) circulates a refrigerant, a steam compression freezing cycle is performed. This refrigerant circuit (100) constitutes heat source means. A first adsorbing element (111) and a second adsorbing element (112) have adsorbing agents such as zeolite, each constituting an adsorption member. Further, each adsorbing element (111 and 112) is formed of numerous air paths, and air when passing through these paths comes in contact with the adsorbing agent.

Figure 5A:
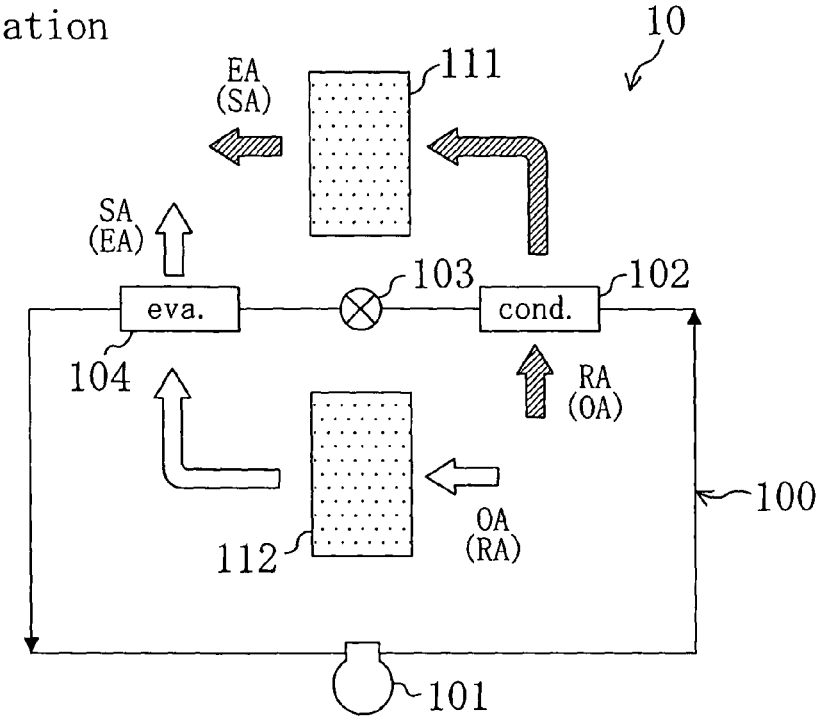
FIG. 5 is a schematic block diagram of a humidity controller in a first modified example of another embodiment; (A) shows operation during the first operation, and (B) shows operation in the second operation.
Figure 5B:
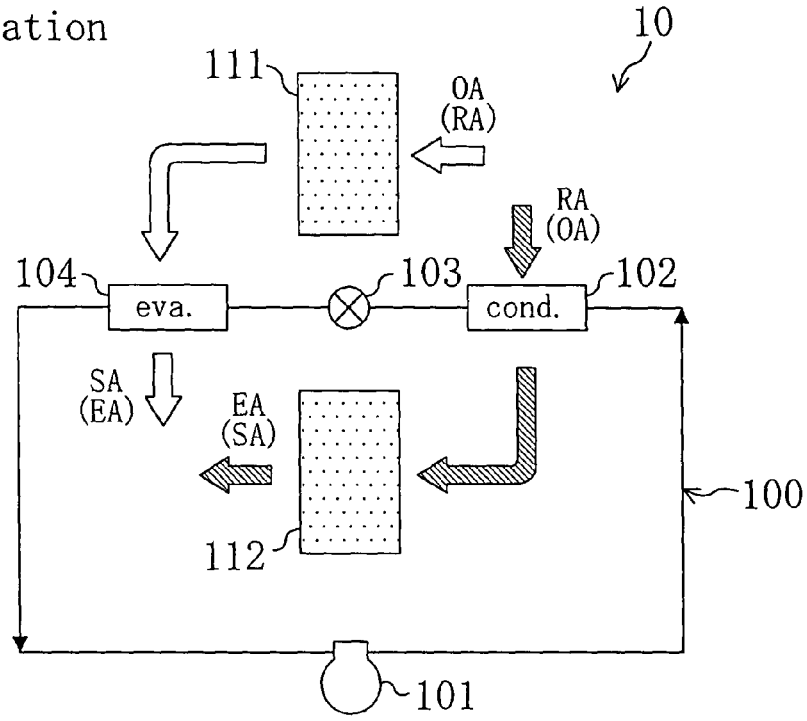

This humidity controller (10) repeats the first operation and the second operation. As shown in FIG. 5(A), the humidity controller (10) in the first operation supplies air heated in the condenser (102) to the first adsorbing element (111) to regenerate the adsorbing agent, while refrigerating in the evaporator (104) the air which has been deprived of moisture by the second adsorbing element (112). Further, as shown in FIG. 5(B), the humidity controller (10) in the second operation supplies air heated in the condenser (102) to the second adsorbing element (112) to regenerate the adsorbing agent, while refrigerating in the evaporator (104) the air which has been deprived of moisture by the first adsorbing element (111). The humidity controller (10) performs, through switching, the dehumidifying operation of supplying to the room the air which is dehumidified while passing through the adsorbing elements (111 and 112) and the humidifying operation of supplying to the room the air which is humidified while passing through the adsorbing agents (111 and 112).

Second Modified Example

Figure 6:
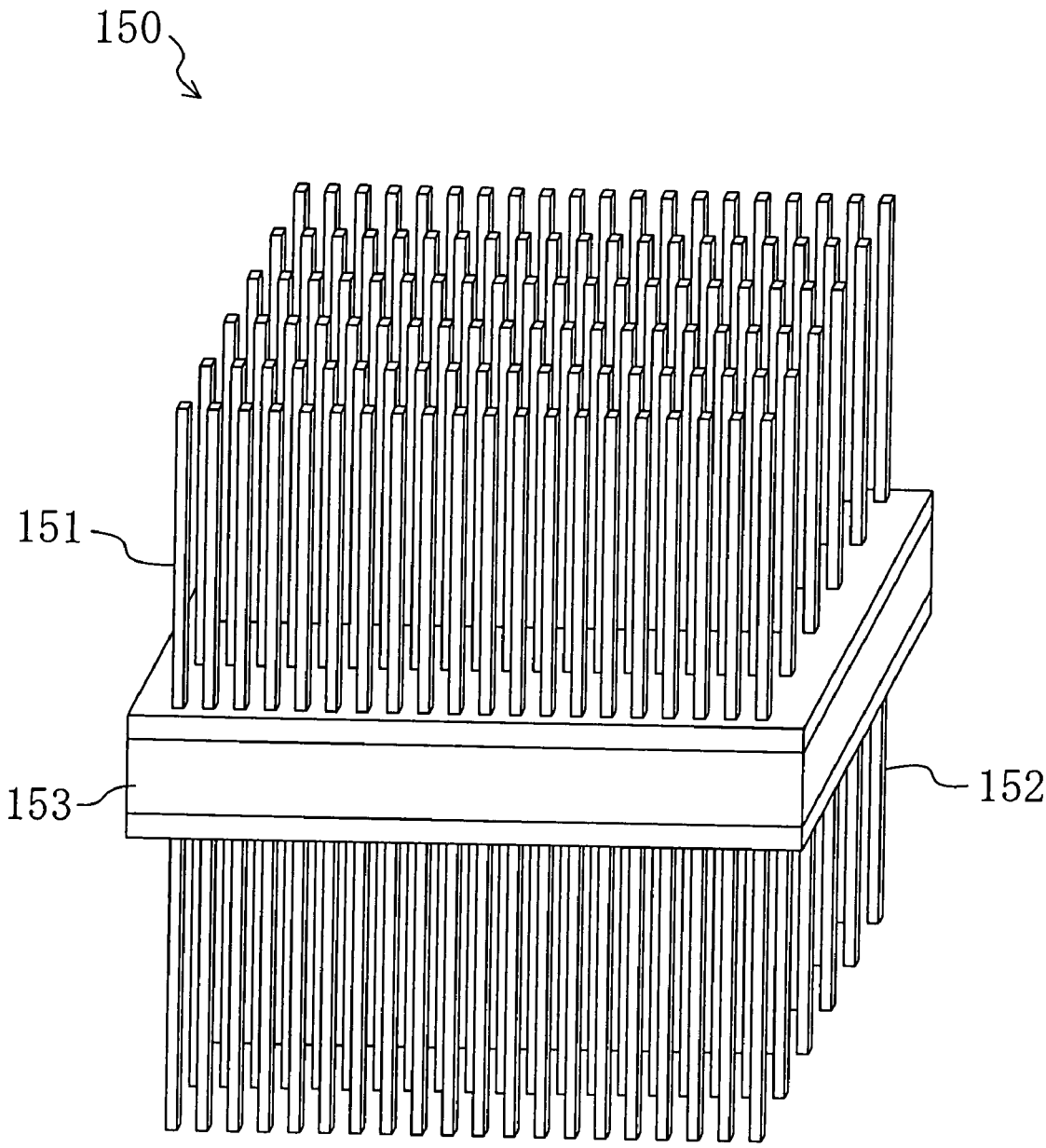
FIG. 6 is a schematic perspective view of a humidity adjustment unit in a second modified example of another embodiment.

As shown in FIG. 6, the humidity controller (10) of the second modified example is provided with a humidity adjustment unit (150). This humidity adjustment unit (150) is provided with a Peltier element (153) and a pair of adsorbing fins (151 and 152). The adsorbing fins (151 and 152) are each composed of a so-called heat sink whose surface supports the adsorbing agent such as zeolite. The adsorbing fins (151 and 152) constitute adsorbing members. On one surface of the Peltier element (153) is connected a first adsorbing fin (151), while on the other surface thereof is connected a second adsorbing fin (152). When a direct current is run on the Peltier element (153), one of the two adsorbing fins (151 and 152) becomes a heat adsorption side while the other becomes a heat release side. The Peltier element (153) constitutes heat source means.

The humidity controller (10) repeats the first operation and the second operation. The humidity adjustment unit (150) in the first operation regenerates the adsorbing agent of the first adsorbing fin (151), which became the heat release side, and humidifies air, while causing the adsorbing agent of the second adsorbing fin (152), which became the heat adsorption side, to adsorb moisture and dehumidify air. Further, the humidity adjustment unit (150) in the first operation regenerates the adsorbing agent of the second adsorbing fin (152), which became the heat release side, and humidifies air, while causing the adsorbing agent of the first adsorbing fin (151), which became the heat adsorption side, to adsorb moisture and dehumidify air. The humidity controller (10) performs, through switching, the dehumidifying operation of supplying to the room the air which is dehumidified while passing through the humidity adjustment unit (150) and the humidifying operation of supplying to the room the air which is humidified while passing through the humidity adjustment unit (150).

The embodiments described above represent intrinsically desirable exemplification, and is in no way intended to limit the present invention, its applications or the range of its use.

Industrial Applicability

As described in the foregoing, the present invention is useful for air conditioning systems for air conditioning the same room space by using humidity controllers for processing latent heat and air conditioners for processing sensible heat.

The invention claimed is:

1. An air conditioning system comprising:

a humidity controller for processing a latent heat load of a room;

an air conditioner for processing a sensible heat load of a room, the air conditioning system supplying to the same room air processed in the humidity controller and the air conditioner on the basis of a target temperature Ts and a target relative humidity Rs;

an air conditioning control section for adjusting a processing capacity of the air conditioner such that room temperature may come very close to the target temperature Ts;

an arithmetic section for calculating an absolute humidity as a target absolute humidity As, the target absolute humidity corresponding to the target relative humidity Rs at the target temperature Ts; and a humidity adjustment section for adjusting a processing capacity of the humidity controller such that the absolute humidity of the room may come very close to the target absolute humidity As.

2. The air conditioning system according to claim 1, further comprising an input section through which a user inputs the target relative humidity Rs as a set relative humidity.

3. The air conditioning system according to claim 1, further comprising:

an input section through which a user inputs the target temperature Ts as a set temperature; and a decision-making section for automatically determining the target relative humidity Rs according to the set temperature.

4. The air conditioning system according to claim 1, wherein:

the humidity controller has a refrigerant circuit to which adsorption heat exchangers supporting an adsorbing agent that adsorbs moisture in air is connected, the refrigerant circuit performing a freezing cycle, wherein the air conditioning system adjusts the humidity of air that is in contact with the adsorbing agent of the adsorption heat exchangers by heating or refrigerating the adsorbing agent with a refrigerant of the refrigerant circuit, and processes the latent heat load of the room by supplying the humidity-adjusted air to the room.

5. The air conditioning system according to claim 1, wherein the humidity controller includes a compressor, and a refrigerant circuit to which adsorption heat exchangers supporting an adsorbing agent that adsorbs moisture in air is connected, the refrigerant circuit performing a freezing cycle, the air conditioning system adjusts the humidity of air that is in contact with the adsorbing agent of the adsorption heat exchangers by heating or refrigerating the adsorbing agent with a refrigerant of the refrigerant circuit, and processes the latent heat load of the room by supplying the humidity-adjusted air to the room, and the humidity adjustment section adjusts an operating frequency of the compressor so that the absolute humidity of the room comes close to the target absolute humidity As.

* * * * *